US009138082B2

(12) United States Patent
Crescenzo

(10) Patent No.: US 9,138,082 B2
(45) Date of Patent: Sep. 22, 2015

(54) PIN HANGING SYSTEM FOR TRACK FRAMES

(71) Applicant: Philip J. Crescenzo, Buena, NJ (US)

(72) Inventor: Philip J. Crescenzo, Buena, NJ (US)

( * ) Notice: Subject to any disclaimer, the term of this patent is extended or adjusted under 35 U.S.C. 154(b) by 3 days.

(21) Appl. No.: 13/681,615

(22) Filed: Nov. 20, 2012

(65) Prior Publication Data

US 2014/0137451 A1 May 22, 2014

(51) Int. Cl.

| | |
|---|---|
| ***A47G 1/20*** | (2006.01) |
| ***A47G 1/16*** | (2006.01) |
| ***A47G 1/06*** | (2006.01) |

(52) U.S. Cl.

CPC ..... *A47G 1/1633* (2013.01); *A47G 1/0605* (2013.01); *A47G 1/1626* (2013.01); *A47G 1/1686* (2013.01)

(58) Field of Classification Search

CPC .. A47G 1/1633; A47G 1/1686; A47G 1/1626
USPC ..... 248/475.1, 476, 477, 480, 497, 498, 248/220.21, 220.22, 222.14, 224.51, 248/225.21, 274.1, 279.1, 309.2, 547; 411/439, 473; 40/475

See application file for complete search history.

(56) References Cited

U.S. PATENT DOCUMENTS

| | | | | |
|---|---|---|---|---|
| 76,344 | A | | 6/1904 | Winter |
| 1,023,502 | A | | 4/1912 | Callanan |
| 1,297,584 | A | | 3/1919 | Mock |
| 1,676,131 | A | | 7/1928 | Campos |
| 1,883,834 | A | | 10/1932 | Turner |
| 3,300,173 | A | | 1/1967 | Kennedy |
| 3,551,939 | A | | 1/1971 | Rager |
| 3,858,269 | A | | 1/1975 | Sutton et al. |
| 4,083,525 | A | | 4/1978 | Rath |
| 4,226,394 | A | * | 10/1980 | Einhorn ..... 248/223.41 |
| 4,566,665 | A | | 1/1986 | Rynearson |
| 4,637,583 | A | | 1/1987 | Babitz |
| 4,858,351 | A | | 8/1989 | Sewell et al. |
| 4,970,754 | A | | 11/1990 | Anderson et al. |
| 5,015,118 | A | | 5/1991 | Sewell et al. |
| 5,328,139 | A | | 7/1994 | Barnes |
| 5,332,108 | A | | 7/1994 | Blass |
| 5,409,489 | A | | 4/1995 | Sioufi |

(Continued)

FOREIGN PATENT DOCUMENTS

| | | |
|---|---|---|
| GB | 2333820 | 8/1999 |
| RU | 2082307 | 6/1997 |

OTHER PUBLICATIONS

Copending, U.S. Appl. No. 13/193,067, filed Jul. 28, 2011.

(Continued)

*Primary Examiner* — Kimberly Wood
(74) *Attorney, Agent, or Firm* — Cohen & Hildebrand, PLLC

(57) ABSTRACT

A system for hanging a framed object using a pin hanger including a neck section having a top surface and two outer lateral edges. An intermediate shoulder section having two outer lateral edges extends outward beyond that of the outer lateral edges of the neck section forming substantially planar ledges. An inward tapered section starts from the outer lateral edges of the intermediate shoulder section and terminates in a substantially planar bottom surface that is substantially parallel to the top surface of the neck section. A pin projects from the top surface of the neck section at an angle less than 90 degrees relative to the top surface of the neck section. The pin hanger is releasably secured at any desired location within the track frame section via a set screw received within a hole.

18 Claims, 6 Drawing Sheets

(56) References Cited

U.S. PATENT DOCUMENTS

| | | | | |
|---|---|---|---|---|
| 5,454,542 | A | 10/1995 | Hart | |
| 5,584,462 | A * | 12/1996 | Reese | 248/477 |
| 5,588,629 | A | 12/1996 | Barnes | |
| 5,605,313 | A | 2/1997 | Erickson et al. | |
| 5,794,901 | A * | 8/1998 | Sigel | 248/221.11 |
| D402,183 | S | 12/1998 | Bellehumeur | |
| 5,878,987 | A | 3/1999 | Hayde | |
| 6,042,078 | A | 3/2000 | Donovan | |
| 6,095,478 | A | 8/2000 | Barnes | |
| 6,126,126 | A | 10/2000 | McKiernan et al. | |
| 6,186,466 | B1 | 2/2001 | Baird et al. | |
| 6,206,334 | B1 | 3/2001 | Weck et al. | |
| 6,241,210 | B1 | 6/2001 | Brindisi | |
| 6,439,520 | B1 | 8/2002 | Johnson | |
| 6,471,169 | B1 | 10/2002 | Maloney | |
| 6,484,996 | B2 | 11/2002 | Astell | |
| 6,708,367 | B2 | 3/2004 | Billson | |
| 6,840,489 | B2 | 1/2005 | Barnes | |
| 6,957,717 | B1 | 10/2005 | White et al. | |
| 6,962,016 | B1 | 11/2005 | Meyer | |
| 7,249,624 | B2 * | 7/2007 | Zeh et al. | 160/371 |
| D572,122 | S | 7/2008 | Cave | |
| 7,431,258 | B2 | 10/2008 | Lamotta | |
| 7,497,028 | B2 | 3/2009 | Nevers et al. | |
| 7,891,616 | B2 | 2/2011 | Pinchuk et al. | |
| 2006/0282981 | A1 | 12/2006 | Speck et al. | |
| 2007/0194191 | A1 * | 8/2007 | Persson | 248/225.11 |
| 2007/0286704 | A1 | 12/2007 | Signor | |
| 2009/0294610 | A1 | 12/2009 | Paharik et al. | |
| 2010/0096532 | A1 | 4/2010 | Greve | |
| 2010/0102011 | A1 * | 4/2010 | Blum | 211/8 |

OTHER PUBLICATIONS

Copending, U.S. Appl. No. 13/846,416, filed Mar. 18, 2013.
www.OOK.com (internet website)(date unknown) [1 page].
PCT International Search Report and Written Opinion of counterpart PCT/US2013/070646, Feb. 20, 2014 (7 pages).

* cited by examiner

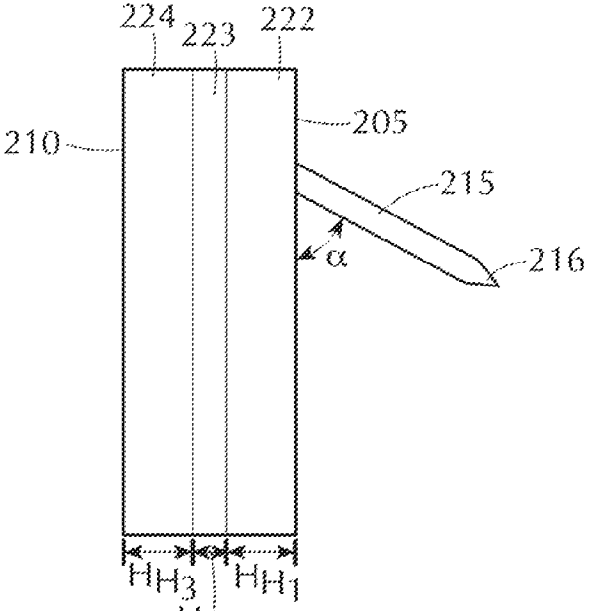
FIG. 2C
FIG. 2B
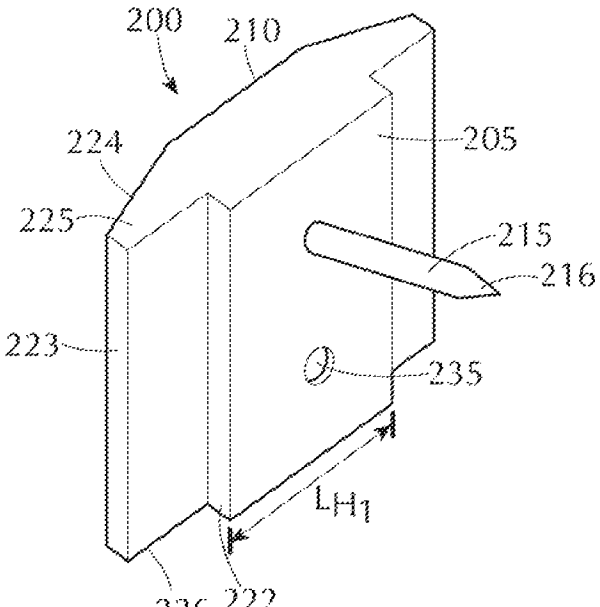
FIG. 2A

PIN HANGING SYSTEM FOR TRACK FRAMES

BACKGROUND OF THE INVENTION

1. Field of the Invention

The present invention is directed to a pin hanging system for track frames used to display photos, art work, objects, diplomas or any other item to be framed.

2. Description of Related Art

Conventional track frames used to frame an photographs, mirrors, diplomas or any other objects are known. These track frames are typically made of metal and represent multiple track frame sections assembled together end-to-end funning, a closed frame, typically in the shape of a rectangle or square.

Picture frames are generally hung from the wall using a wire. The use of a wire creates instability in the object being hung when the wire slides along the hook secured to the wall and/or the object hangs against the wall on which it is hung. Moreover, when hanging a framed object using a wire it is difficult to insure that it is level. It is thus desirable to develop a hanging system and apparatus that eliminates the use or need for any wires and insures that the frame is level, stable and completely flush against the wall or other vertical service to which it is to be mounted.

It would be further desirable to provide a hanging system that may be provided, with but disassembled from a framed object at the time of purchase from a manufacturer, distributor, retail outlet, or any other individual or establishment. On-line retail market sales are increasing every year. Thus, shipment of the framed object with its hanging system is another concern from the standpoint of safety, increased weight and ease of assembly by the consumer once they receive the package. It would be desirable to develop a hanging system that may be shipped to the consumer disassembled from but with the framed object and easily assembled within the frame thereafter using only tools commonly found in consumers homes.

As previously noted, when shipped to the consumer the framed object itself is fully assembled. Therefore, it would be further desirable to develop a hanging system and apparatus that would not require the disassembly of any part of the assembled frame to install. That is, it would be desirable for the hanging system to be fully insertable into/fully removable from any desired location along the assembled track frame using conventional tools available in almost every home without having to disassemble the frame or necessarily remove the pin hanger from the track frame.

SUMMARY OF THE INVENTION

The present invention is directed to an inventive hanging system for an assembled framed object to be hung on a wall or other surface that solves the aforementioned problems.

An aspect of the present invention is directed to a system for hanging a framed object that includes a pin hanger comprising: a neck section having a top surface and a width defined by two outer lateral edges defining a single step down transition region; an intermediate shoulder section having a width defined by two outer lateral edges extending outward beyond that of the outer lateral edges of the neck section forming substantially planar ledges; and an inward, tapered section starting from the outer lateral edges of the intermediate shoulder section and terminating in a substantially planar bottom surface that is substantially parallel to the top surface of the neck section; outer lateral edges of the inward tapered section are angled relative to the outer lateral edges of the intermediate shoulder section at an angle less than 90 degrees. A pin projects from the top surface of the neck section at an angle less than 90 degrees relative to the top surface of the neck section. Defined in the pin hanger is a hole extending from the top surface of the neck section to the bottom surface of the tapered section with a screw receivable within the hole.

Another aspect of the present invention is directed to a method for hanging a framed object to a surface using the system in accordance with the system in the preceding paragraph. Initially, the pin hanger is positioned at a desired location along the track frame section with a pointed end of the pin facing outward away from the track frame section. Prior to insertion into the opening, the pin hanger is oriented so that the outer lateral edges the neck section are substantially aligned with terminating edges of the shoulders of track frame section; in this position, the intermediate shoulder section prevents the pin hanger from being fully insertable into the opening of the track frame section. Then one side of the pin hanger is rotated until one of the outer lateral edges of the intermediate shoulder section is insertable via the opening into the track frame section and an associated ledge of the intermediate shoulder section parallel to the top surface of the neck section is received beneath an associated shoulder of the track frame section of the same side. That side of the pin hanger inserted into the opening of the track frame section is shifted towards an interior surface of a side wall of the track frame section. While the one side ledge is maintained within the track frame section beneath the associated shoulder on the same side, the opposite side of pin hanger is rotated by substantially a same amount in an opposite direction relative until an opposing outer edge of the intermediate shoulder section clears the corresponding shoulder passing through the opening into the track frame section whereby the pin hanger is fully inserted within the track frame section. Thereafter, the outer edges of neck section are realigned with the shoulders of the track frame section. The pin hanger is pulled until the ledges of the intermediate shoulder section are in physical contact with respective interior surfaces of the shoulders of the track frame section. Lastly, the pin hanger is releasably secured in place within the track frame section at any desired location.

BRIEF DESCRIPTION OF THE DRAWING

The foregoing and other features of the present invention will be more readily apparent from the following detailed description and drawings of illustrative embodiments of the invention wherein like reference numbers refer to similar elements throughout the several views and in which:

FIG. 2A is a perspective view of the pin hanger in accordance with the present invention;

FIG. 2B is a side view of the pin hanger of FIG. 2A;

FIG. 2C is a front view of the pin hanger of FIG. 2A;

DETAILED DESCRIPTION OF THE INVENTION

Figure 3A:
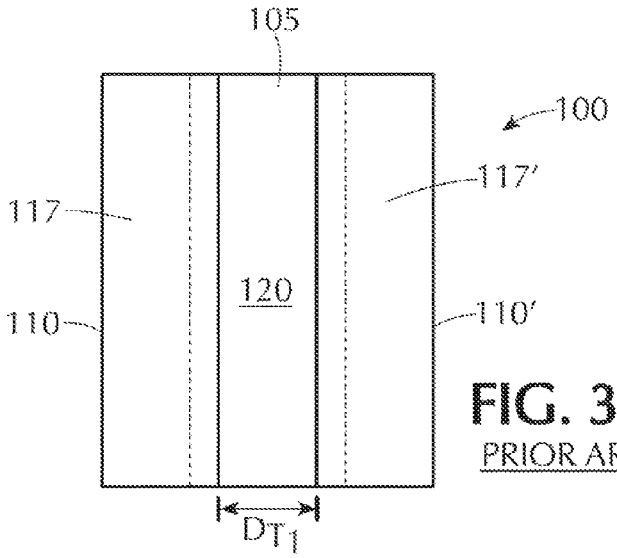
FIG. 3A PRIOR ART
FIG. 3A is a front view of a prior an buck frame section.
Figure 3B:
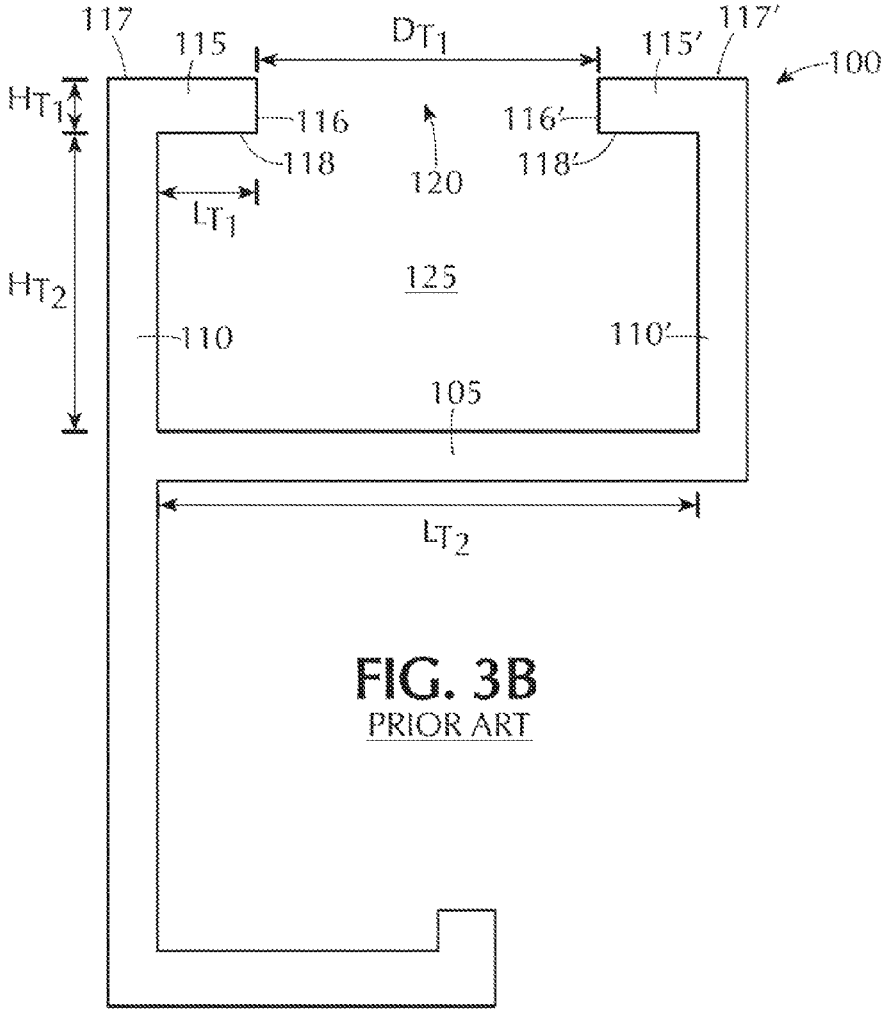
FIG. 3B PRIOR ART
FIG. 3B is an end view of the prior art track frame section of FIG. 3A.

The present invention is directed to a pin hanger sized and shaped to be received within a conventional standard size track frame section forming part of a frame (typically made of metal, plastic or other rigid material) for an object or picture such as but not limited to a photograph, piece of art, diploma or any other item to be framed and hung on a wall or other surface. FIG. 3A is a top view of a single piece of a standard metal track frame section 100. By way of illustrative example, the ends of four track frame sections 100 may be assembled together end-to-end forming a closed rectangular frame. However, other open or closed shape frames firmed by any number of one or more track frame sections are contemplated and within the intended scope of the present invention. Referring to FIG. 3B, track frame section 100 includes a substantially C-shaped channel with an L-shaped ledge projecting therefrom. The substantially C-shaped channel formed by a substantially planar bottom wall 105; opposing side walls 110, 110', each side wall is arranged substantially perpendicular to the bottom wall 105 and substantially parallel to one another; shoulders 115, 115' extend toward one another substantially perpendicularly from the respective side walls 110, 110' and substantially parallel with the bottom wall 105. Terminating edges 116, 116' of the respective shoulders 115, 115' are separated from one another by a predetermined distance $D_{T1}$ thereby forming, an opening 120 of the substantially C-shaped channel. Opening 120 is defined in that surface of the frame that is in physical contact with the surface on which the object is to be mounted (e.g., wall). Each shoulder 115, 115' has a height $H_{T1}$ (extending from its exterior surface 117, 117' to its interior surface 118, 118') and a length $L_{T1}$ (extending, from terminating edge 116, 116' to an interior surface of the respective side wall 110, 110'). Still referring to FIG. 3B, the track 100 defines an internal cavity 125 defined by $H_{T2}$ (height of the internal cavity, measured from an interior surface 118, 118' of the shoulder 115 to an interior surface of the bottom wall 105) and $L_{T2}$ (length of the internal cavity between the interior surfaces of the respective side walls 110, 110'). The object to be framed (e.g., a photograph) is typically disposed between a transparent plate and a lower supporting mat/substrate, which all together are secured within the upper L-shaped ledge portion of the track frame section and the bottom wall 105 of the substantially C-shaped channel.

Pin hanger 200 is adapted to be received within and releasably securable at any desired position along the track frame section 100 without having to disassemble the closed frame. Accordingly, the pin hanger may be retrofit to a preassembled closed frame without having to disassemble the frame. The pin hanger in accordance with the present invention is therefore particularly well suited to be retrofit with assembled frames having no open terminating end.

Figure 1A:
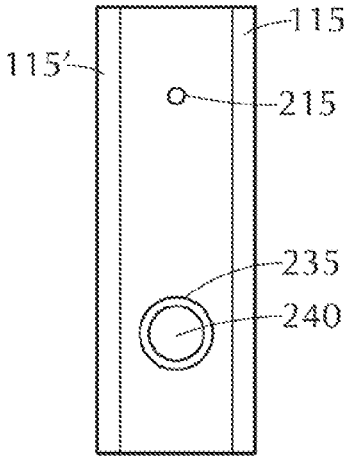
FIG. 1A is a rear view of an exemplary assembled pin hanger and track frame section in accordance with the present invention assembled within a metal track frame section.
Figure 1B:
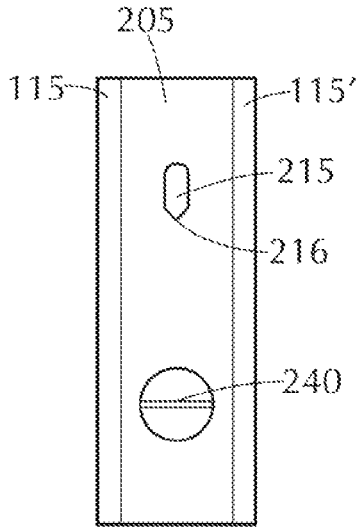
FIG. 1B is a front view of the assembled pin hanger and track frame section of FIG. 1A.
Figure 1C:
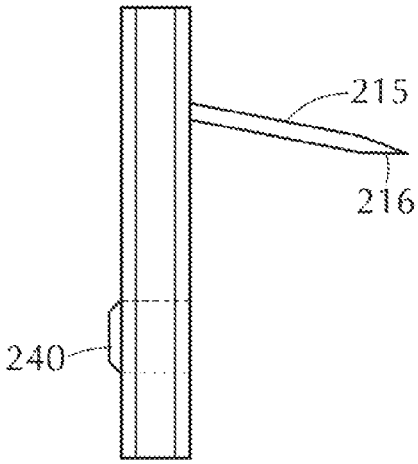
FIG. 1C is side view of the assembled pin hanger and track frame section of FIG. 1A.
Figure 1D:
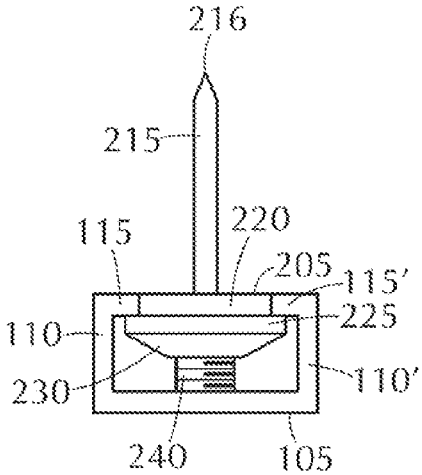
FIG. 1D is an end view of the assembled pin hanger and track frame section of FIG. 1A.
Figure 2E:
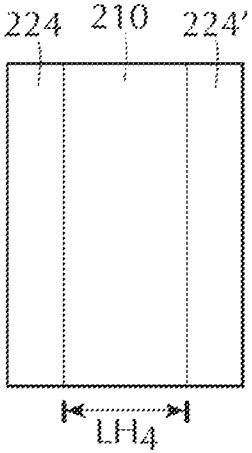
FIG. 2E is a back view of the pin hanger of FIG. 2A.
Figure 2D:
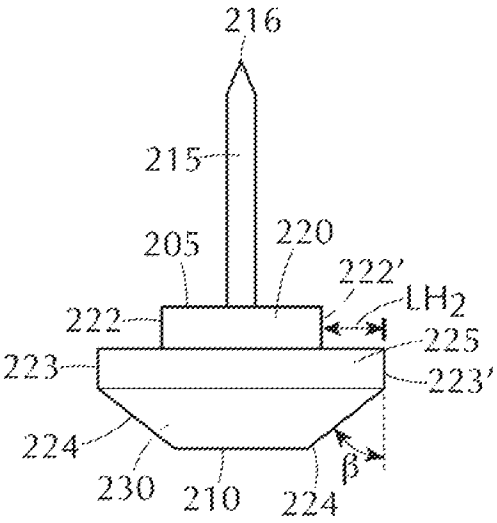
FIG. 2D is an end view of the pin hanger of FIG. 2A.

Referring to the end view in FIG. 2D, pin hanger 200 includes a pin 215 having a pointed end 216 and an opposite end projecting from a substantially planar top surface 205 of a neck section 220. The pointed end 216 allows the hanger to puncture the wall on which the object is to be hung by simply pressing firmly. At every point in an axial direction, the pin preferably has a circular cross-section. With the exception of the pointed end 216, at every point in an axial direction pin 215 preferably has a substantially uniform diameter circular cross-section. The circular cross-section of the pin allows it to be inserted into a variety of surfaces such as wood, metal, cement, dry wall, etc. If the surface into which the pin is to be inserted is significantly hard as to preclude insertion by mere pushing, a pilot hole may be predrilled into the surface.

Instead of using a pin having a circular cross-section at all times in an axial direction, a two-dimensional prong having a non-circular cross-section and terminating in a pointed end may be stamped or struck from the material that forms the hanger itself. Due to its non-circular cross-section, the prong embodiment is restricted in use to hanging the framed object in drywall and not able to hold as much weight as the pin embodiment. Such stamped prong preferably has a uniform width with the exception of its pointed end. Once stamped from a metal plate, the manufactured prong may thereafter be mounted to the top surface 205 of the neck section 220.

The pin hanger may be any desired longitudinal length so long as it does not exceed the longitudinal length of the track frame section 100 into which it is to be received. In a lateral direction (perpendicular to the longitudinal direction) the top surface 205 of the neck section 220 has a length $L_{H1}$. In order to maximize stability by minimizing any movement of the hanger 200 when assembled within the track frame section 100, the length $L_{H1}$ of the top surface 205 of the neck section 220 is preferably approximately equal to the distance $D_{T1}$ in a lateral direction of opening 120 of the substantially C-shaped track. Outer lateral edges 222, 222' of the neck section 220 define a single step down transition of a height $H_{H1}$ to an intermediate shoulder section 225. The height $H_{H1}$ of the neck section 220 is preferably substantially equal to the height $H_{T1}$ of the shoulders 115, 115' so that when assembled the top surface 205 of the neck section 220 of the hanger 200 is substantially flush with the exposed outer surfaces 117, 117' of the shoulders 115, 115' of the track frame section 100. This allows the assembled hanger and frame to be flush with the wall or other surface on which it is hung. In turn, outer lateral edges 223, 223' of the intermediate shoulder section 225 extend outward in a lateral direction relative to the outer lateral edges 222, 222' of the neck section 205 forming substantially planar ledges 226, 226' having a length $L_{H2}$ that is less than $L_{T1}$ (the length of the respective shoulders 115, 115' from its terminating edges 116, 116' to where it reaches the interior surface of the side walls 110, 110'). Preferably, the top surface 205 of the neck section 220 is substantially parallel to the substantially planar ledges 226, 226'. When the hanger 200 is assembled within the track frame section 100 with the neck section 220 secured between the shoulders 115, 115', a clearance exists between the outer lateral edges 223, 223' of the intermediate shoulder section 225 and the respective interior surfaces of the side walls 110, 110' of the track frame section 100. This clearance is sufficient so that when one of the later edges 223, 223' is in physical contact with the interior surface of the side walls 110, 110', by rotating or tilting the pin hanger 200 its opposite edge 223, 223' is able to clear the terminating end 116, 116' of the shoulder 115, 115' allowing the pin hanger 200 to be readily removed at any desired position from the track. Outer lateral edges 223, 223' of the intermediate shoulder section 225 have a height $H_{H2}$. Intermediate shoulder section 225 is immediately followed by an inward tapered section 230 starting from the outer lateral edges 223, 223' of the intermediate shoulder section 225 and terminating at a substantially planar bottom surface 210 that is substantially parallel with that of top surface 205 of the neck section 220. Each outer lateral edges 224, 224' of the inward tapered section 230 is defined by an angle β (FIG. 2D), preferably approximately 45 degrees, relative to a plane defined by respective outer lateral edges 223, 223' of intermediate section 225. Bottom surface 210 has a length $L_{H4}$ in a lateral direction that is less than the opening 120 of the substantially C-shaped track, most preferably less than the distance $L_{H1}$ of the neck section 220. The inward tapered section 230 has a height $H_{H3}$. Sections 220, 225, 230 as well as the pin 215 may be formed as an integral unit or separate pieces secured or attached together. Preferably, sections 220, 225, 230 are a single integral unit may of the same material.

A hole or aperture 235 is defined in the pin hanger 200 extending therethrough between top surface 205 and bottom surface 210, with an axial direction of the hole being oriented substantially perpendicular to these surfaces. A set screw 240 or other releasable securing hardware is received within the hole or aperture 235 temporarily securing the pin hanger 200 in place at any desired position along the track frame section 100. When the set screw 240 is screwed in tightly securing the pin hanger in place the terminating end of the set screw, opposite its head, extends physically beyond the bottom surface 210 of the pin hanger 210 and is in physical contact with an interior surface of the bottom wall 105 of the substantially C-shaped channel.

Pin 215 is disposed at an angle $\alpha$ of less than 90 degrees with respect to top surface 205. This acute angle assists in drawing the frame flush against the wall. The angle $\alpha$ may be between approximately 50 degrees and approximately 80 degrees. Preferably, the angle $\alpha$ is between approximately 75 degrees and approximately 80 degrees. Most preferably, angle $\alpha$ is approximately 75 degrees. Pin 215 is non-moveably mounted to the neck section.

Figure 4C:
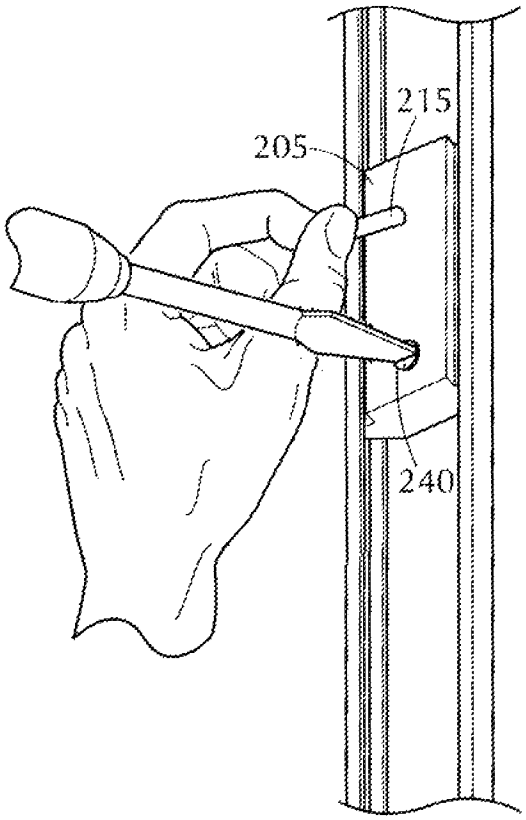
FIGS. 4A-4C are sequential drawings depicting each step in the process of installing the pin hanger in the track frame section in accordance with the present invention.
Figure 4B:
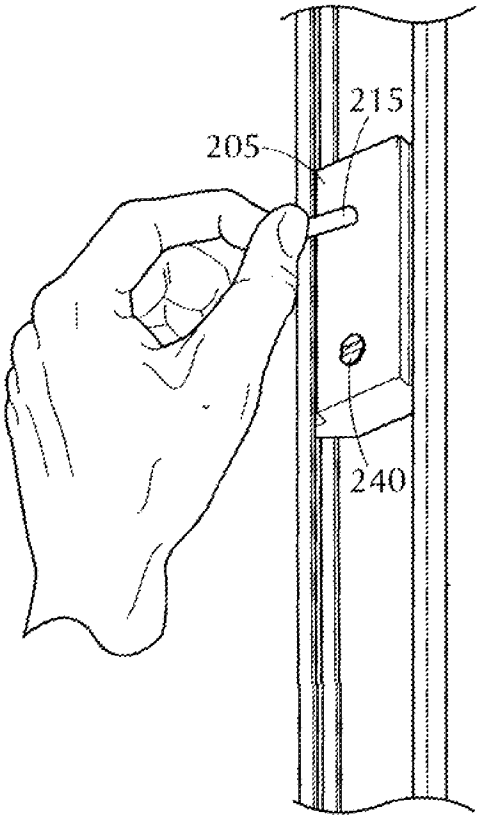
Figure 4A:
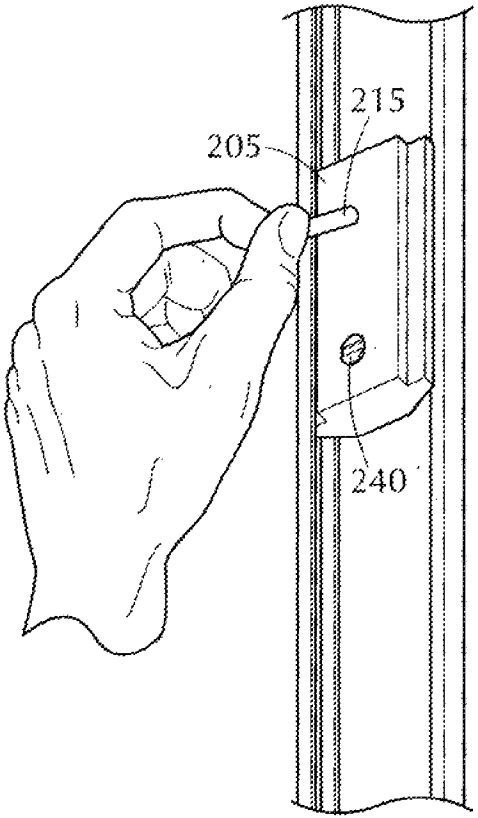
Figure 5:
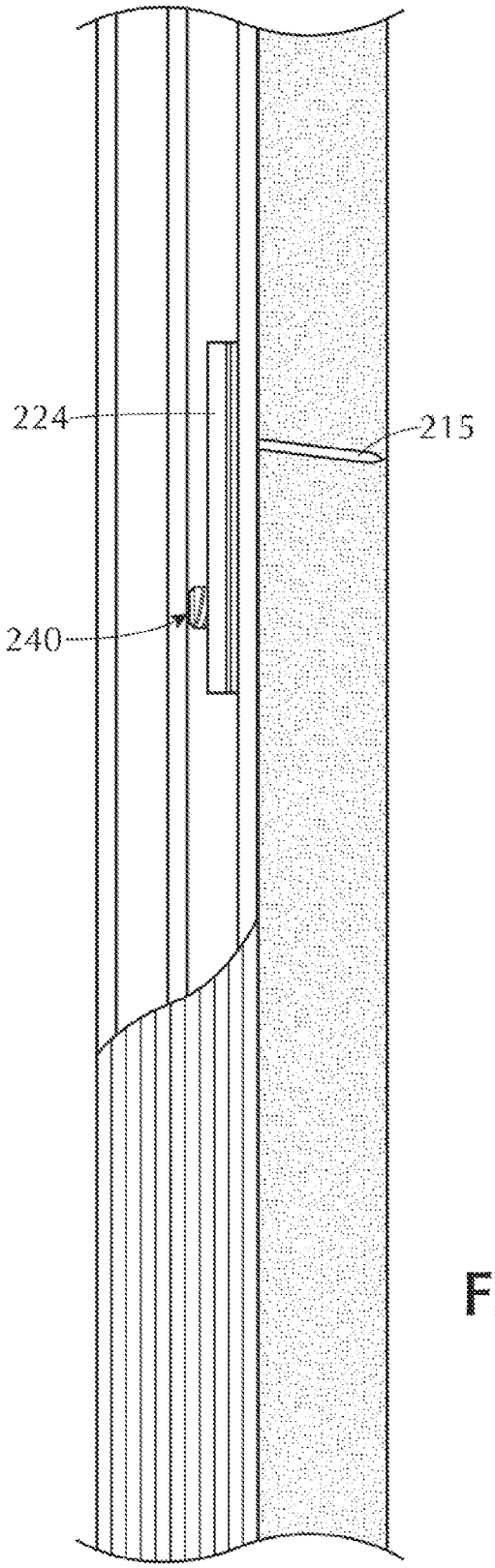
FIG. 5 is a side view of the assembled pin hanger and frame mounted to a wall.

FIGS. 4A-4C illustrate sequential steps in assembly of the pin hanger 200 within the track frame section 100. To assemble the pin hanger 200 securely within the track frame section 100 prior to hanging the framed object on the wall or other surface, the hanger 200 is first arranged with the pointed, end. 216 of the pin 215 facing outward away from the bottom wall 105 of the substantially C-shaped channel. During assembly the pin hanger 200 may be easily held by the pin 215. Prior to insertion into the opening 120 of the substantially C-shaped channel, the hanger 200 is oriented so that the outer lateral edges 222, 222' of the neck section 220 are substantially aligned with the respective terminating edges 116, 116' of the shoulders 115, 115' of track 100. At this point in time, the enlarged intermediate shoulder section 225 (whose width in a lateral direction exceeds that of the opening 120 of the track 100) prevents hanger 200 from being fully inserted into the opening 120 of the track 100. To realize full insertion, the one side of the hanger 200 is tilted or rotated until one of the outer lateral edges 223, 223' of the intermediate shoulder section 225 is insertable via the opening 120 into the internal cavity 125 and the associated ledge 226, 226' is received beneath an associated shoulder 115, 115' on the same side. Preferably, the pin hanger is rotated approximately +/−45 degrees to enter the track frame channel. The side of the hanger 200 inserted into the internal cavity 125 is shifted so that the associated outer lateral edge 223, 223' on the same side physically comes closer, possibly even physically contacting, the interior surface of the side wall 110, 110' of the track. While the one side ledge 226, 226' is maintained within the internal cavity 125 beneath the shoulder 115, 115' on the same side, the opposite side of hanger 200 is tilted or rotated substantially the same amount in an opposite direction relative to the longitudinal axis until the other outer edge 223, 223' of the intermediate section 225 clears the associated terminating end 116, 116' of the corresponding shoulder 115, 115'. At this point in time, the hanger 200 is fully inserted with the inward tapered section 230, intermediate shoulder section 225 and neck section 220 all received within the internal cavity 125 of the track 100. Once fully inserted, the outer edges 222, 222' of neck section 220 are substantially realigned in a longitudinal direction with the terminating ends 116, 116' of the shoulders 115, 115' of the track. Holding on to the pin 215, the user moves the hanger 200 upwards (in a direction away from the bottom wall 105) from the track until the ledges 226, 226' of the intermediate shoulder section 225 are in physical contact with the respective interior surfaces 118, 118' of the shoulders 115, 115'. In this position, rocking movement of the hanger within the track is substantially reduced or prevented by terminating edges 116, 116' of the shoulders 115, 115'. Temporary positioning of the hanger 200 at a desired location within the track 100 is secured in place by a set screw 240 or other equivalent mechanical device received within the hole or opening 235. When fully inserted, set screw 240 projects from the bottom surface 210 of the pin hanger 200 and rests against the bottom wall 105 of the substantially C-shaped channel thereby temporarily securing the hanger therein at a desired location.

Removal of the hanger 200 from within the track 100 follows a similar procedure in reverse. Set screw 240 is released from the hole or opening 235 by unscrewing it, preferably until it is at least flush with the bottom surface 210 of the pin hanger 200 so as not to be an obstruction during removal of the pin hanger from the internal cavity 125 of the track frame section. While holding pin 215, the hanger 200 is pushed downward into the internal cavity 125 until the neck section 220 clears the opening 120. The pin hanger 200 is positioned so that one of the outer lateral edges 223, 223' is moved closer towards and perhaps in physical contact with the interior surface of the associated side wall 110, 110'. Then the user tilts or rotates the hanger about its longitudinal axis until one of the opposite outer lateral edges 223, 223' of the intermediate shoulder section 225 is able to pass through the opening 120. Once the one side of the pin hanger passes fully through the opening 120, the pin hanger is tiled or rotated about is longitudinal axis in an opposite direction until the other outer lateral edge 223, 223' of the intermediate shoulder section 225 is able to pass through the opening 120. Now that the hanger has been fully removed from within the track it may be relocated to a new position along, the same or different track frame section.

Instead of removing the hanger from the frame, the pin hanger may be readily repositioned within the track frame section by simply releasing the set screw 240 and sliding the pin hanger 200 within the track 100 to a different location within the same track frame section. Repositioning of the hanger may therefore be realized by either sliding the hanger while being maintained within the internal cavity or, alternatively, by removing the hanger from the track altogether and following the sequence of steps above at the new location.

Once the hanger has been assembled and temporarily secured at a desired location within the metal frame, the assembly may readily be hung on the wall or other surface by simply pushing the framed object until the pointed end of the pin penetrates into the wall and the top surface 205 of the neck section 220 along with the exterior surfaces of the shoulders 115, 115' are all flush with the wall surface. Automatically, the hung framed object is level, stable (prevents rocking) and flush with the wall.

The present claimed invention has been illustrated and described with respect to a single pin hanger assembled in a metal track frame. It is, however, contemplated and within the intended, scope of the present invention to use more than one pin hanger, with each hanger having its own associated pin, assembled in the same track frame section or different track frame sections that formed a closed assembled frame.

The measurements associated with the conventional track frame are substantially standard. By way of illustrative, non-limiting example, the standardized measurements of the substantially C-shaped channel of the track frame section are typically as follows: $H_{T1}$ is substantially 7/32"; $H_{T2}$ is substantially 5/32"; $D_{T1}$ is substantially 3/8"; $L_{T1}$ is substantially 3/32"; $L_{T2}$ is substantially 1/2". Exemplary complementary size pin hanger measurements for such an example standardized C-shaped channel are as follows: $H_{H1}$ is substantially 7/32"; $H_{H2}$ is substantially 5/32"; $H_{H3}$ is substantially 1/8"; $L_{H1}$ is substantially 5/16'" $L_{H2}$ is substantially 1/16"; $L_{H4}$ is substantially 5/16"; $\alpha$ is approximately 75 degrees; and $\beta$ is approximately 45 degrees.

The measurements of the L-shaped ledge portion of the track frame section have no bearing, whatsoever, on the scope of the present invention. As for the particular measurements of the substantially C-shaped channel section, these measurements may be varied, as desired. In such case, the corresponding measurements of the pin hanger may be appropriately varied to complement those of the substantially C-shaped channel section while satisfying the following conditions: (i) the hanger profile is specifically designed to be fully insertable within the within the substantially C-shaped channel only after tilting/rotating in a longitudinal direction from one side followed thereafter h its opposite side; (ii) once inserted within the cavity of the channel, shifting of the hanger therein is prohibited by its complementary shape hounded between the terminating ends 116, 116'; (iii) once fully inserted within the substantially C-shaped track frame the pin hanger is releasably securable therein at any desired location along the track without having to be removed from the end of the track frame section or disassemble the closed frame; and (iv) when assembled and secured within the substantially C-shaped channel, a top surface 205 of the pin hanger together with the exterior surfaces 117, 117' of the shoulders 115, 115', all rest flush against the surface on which the framed object is to be hung.

The present inventive hanging system may be retrofit to preassembled framed objects having a substantially C-shaped track frame without having to disassemble the frame.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

Every issued patent, pending patent application, publication, journal article, hook or any other reference cited herein is each incorporated by reference in their entirety.

What is claimed is:

1. A system for hanging a frame, the system comprising:

a pin hanger including:

a neck section having a planar top surface and a width defined by two outer lateral edges defining a single step down transition region;

an intermediate shoulder section having a width defined by two outer lateral edges extending outward beyond that of the outer lateral edges of the neck section forming ledges;

an inward tapered section starting from the outer lateral edges of the intermediate shoulder section and terminating in a planar bottom surface; outer lateral edges of the inward tapered section are angled relative to the outer lateral edges of the intermediate shoulder section at an angle less than 90 degrees; and a pin projecting from the top surface of the neck section at an angle less than 90 degrees relative to the top surface of the neck section;

wherein a circumference of the pin is less than the width of the top surface of the neck, wherein defined in the pin hanger is a hole extending from the top surface of the neck section to the bottom surface of the tapered section; and a screw receivable within the hole; the pin hanger being secured within the frame only by the screw and the intermediate should section; nothing disposed about the circumference of the pin secures the pin hanger within the frame, wherein the pin is non-moveable at all times relative to the top surface of neck section.

2. The system in accordance with claim 1, wherein the neck section, the intermediate shoulder section and the inward tapered section are a single integral component.

3. The system in accordance with claim 1, wherein the neck section, the intermediate shoulder section and the inward tapered section are two or more separate pieces.

4. The system in accordance with claim 1, wherein except for its pointed end, the pin has a substantially uniform width at every point in an axial direction.

5. The system in accordance with claim 1, wherein the pin has a circular cross section or is a stamped prong.

6. The system in accordance with claim 1, wherein the angle of he pin is between approximately 50 degrees and approximately 80 degrees.

7. The system in accordance with claim 1, wherein the frame is formed by a track frame section including a C-shaped track having an opening defined therein defined by two opposing shoulders separated from one another by a predetermined distance and transitioning into a pair of substantially vertical side walls.

8. The system in accordance with claim 7, wherein the pin hanger is insertable/removable at any desired position along the track frame section without having to disassemble the track frame section.

9. The system in accordance with claim 7, wherein the track frame section is a closed structure without any open terminating ends.

10. The system in accordance with claim 7, wherein the frame is preassembled and the pin hanger is retrofitable into the preassembled frame without having to disassemble any part of the frame.

11. The system in accordance with claim 7, wherein in a lateral direction the top surface of the neck section has a length approximately equal to a distance in a lateral direction of the opening in the substantially C-shaped track frame section to maximize stability by minimizing any movement of the pin hanger when assembled within the track frame section.

12. The system in accordance with claim 7, wherein when the pin hanger is assembled within the substantially C-shaped track with the neck section secured between the shoulders, a sufficient clearance exists between the outer lateral edges of the intermediate shoulder section and respective interior surfaces of the side walls of the substantially C-shaped track so that when the pin hanger is arranged with one of the outer lateral edges of the intermediate shoulder section proximate the interior surface of a side wall of the substantially C-shaped track, by rotating the pin hanger an opposing outer lateral edge of the intermediate shoulder section is able to pass out from the substantially C-shaped track via the opening.

13. The system in accordance with claim 7, wherein a length in a lateral direction of the planar bottom surface of the pin hanger is less than that of the opening of the substantially C-shaped track.

14. The system in accordance with claim 13, wherein the length in the lateral direction of the planar bottom surface of the pin hanger is less than that of the planar top surface of the neck section.

15. The system in accordance with claim 7, wherein when assembled, the neck section fits within the opening defined in the substantially C-shaped track; and the planar top surface of the neck section along with exterior surfaces of the shoulders are all flush with each other.

16. A method for hanging a frame to a surface using a in hanger including: a neck section having, a planar top surface and a width defined by two outer lateral edges defining a single step down transition region; an intermediate shoulder section having a width defined by two outer lateral edges extending outward beyond that of the outer lateral edges of the neck section forming ledges; an inward tapered section starting from the outer lateral edges of the intermediate shoulder section and terminating in a planar bottom surface; outer lateral edges of the inward tapered section are angled relative to the outer lateral edges of the intermediate shoulder section at an angle less than 90 degrees; and a pin projecting from the planar top surface of the neck section at an angle less than 90 degrees relative to the planar top surface of the neck section; wherein a circumference of the pin is less than the width of the planar top surface of the neck;

wherein the frame is formed by a track frame section including a C-shaped track having an opening defined therein defined by two opposing shoulders separated from one another by a predetermined distance and transitioning into a pair of substantially vertical side walls; said method comprising the steps of:

positioning the pin hanger at any desired location along the track frame section with a pointed end of the pin facing outward away from the substantially C-shaped track;

prior to insertion into the opening, orienting the pin hanger so that the outer lateral edges the neck section are substantially aligned with terminating edges of the shoulders of the substantially C-shaped track; in this position, the intermediate shoulder section prevents the pin hanger from being fully insertable into the opening of the substantially C-shaped track;

rotating one side of the pin hanger until one of the outer lateral edges of the intermediate shoulder section is insertable via the opening into the substantially C-shaped track and an associated ledge of the intermediate shoulder section is received beneath an associated shoulder of the substantially C-shaped track on the same side;

shifting that side of the pin hanger inserted into the opening of the substantially C-shaped track towards an interior surface of a side wall of the substantially C-shaped track;

while the one side ledge is maintained within the substantially C-shaped track beneath the associated shoulder on the same side, the opposite side of pin hanger is rotated by substantially a same amount in an opposite direction relative until an opposing outer edge of the intermediate shoulder section clears the corresponding shoulder passing through the opening into the substantially C-shaped track whereby the pin hanger is fully inserted within the substantially C-shaped track;

realigning the outer edges of neck section with the shoulders of the substantially C-shaped track;

pulling the pin hanger in a direction out from the opening until the ledges of the intermediate shoulder section are in physical contact with respective interior surfaces of the shoulders of the substantially C-shaped track;

releasbly securing the pin hanger in place within the substantially C-shaped track at any desired location without securing anything about the circumference of the pin;

orienting the substantially C-shaped track so that the pin inserted therein faces the surface; and pushing the pin into the surface until the planer top surface of the neck is flush with the surface.

17. The method in accordance with claim 16, wherein the pin hanger is repositionable within the track frame section at any desired location without having to remove the pin hanger from the track frame section.

18. The method in accordance with claim 16, wherein the shifting step comprises shifting that side of the pm hanger inserted into the opening of the substantially C-shaped track until it physically contacts an interior surface of a side wall of the track frame section.

* * * * *

UNITED STATES PATENT AND TRADEMARK OFFICE

CERTIFICATE OF CORRECTION

PATENT NO. : 9,138,082 B2
APPLICATION NO. : 13/681615
DATED : September 22, 2015
INVENTOR(S) : Philip J. Crescenzo It is certified that error appears in the above-identified patent and that said Letters Patent is hereby corrected as shown below:

In the Claims

Col. 9, line 25, delete the ",".

Col. 10, line 45, change "pm" to --pin--.

Signed and Sealed this
Fifth Day of July, 2016

Michelle K. Lee

Michelle K. Lee
*Director of the United States Patent and Trademark Office*